US005131023A

United States Patent [19]

Yasugaki et al.

[11] Patent Number: 5,131,023

[45] Date of Patent: Jul. 14, 1992

[54] IMAGING TYPE X-RAY MICROSCOPE APPARATUS WITH SCHWARZSCHILD OPTICAL SYSTEM

[75] Inventors: Mikiko Yasugaki; Yoshiaki Horikawa, both of Tokyo, Japan

[73] Assignee: Olympus Optical Co., Ltd., Tokyo, Japan

[21] Appl. No.: 659,871

[22] Filed: Feb. 22, 1991

[30] Foreign Application Priority Data

Mar. 1, 1990 [JP] Japan ..... 2-50558

[51] Int. Cl.[5] ..... G21K 7/00

[52] U.S. Cl. ..... 378/43; 378/70; 378/84; 378/145

[58] Field of Search ..... 378/43, 84, 82, 70, 378/145

[56] References Cited

U.S. PATENT DOCUMENTS 5,022,064 6/1991 Iketaki ..... 378/43

*Primary Examiner*—Janice A. Howell
*Assistant Examiner*—Kim-Kwok Chu
*Attorney, Agent, or Firm*—Kenyon & Kenyon

[57] ABSTRACT

An imaging X-ray microscope having an X-ray radiation source, a condenser for condensing X-rays radiated from the X-ray source on an object, an objective for forming an image of the object by the X-rays transmitted through or diffracted by the object, and an X-ray detector for receiving the image formed by the objective, the objective comprising a Schwarzschild optical system in which a concave mirror with an opening in the center thereof and a convex mirror are coaxially arranged in such a manner that the convex mirror opposes to the opening of the concave mirror, the object-side numerical aperture is at least 0.24, and the following condition is satisfied:

$$(N.A.-0.6)/12 \leqq (W_2-W_1)/f \leqq -0.005$$

where N.A. is the object-side numerical aperture of the Schwarzschild optical system, $W_1$ is the distance from the object to the center of curvature of the concave mirror, $W_2$ is the distance from the object to the center of curvature of the convex mirror, and f is the focal length of the Schwarzschild optical system.

2 Claims, 11 Drawing Sheets

FIG. 4 (PRIOR ART)
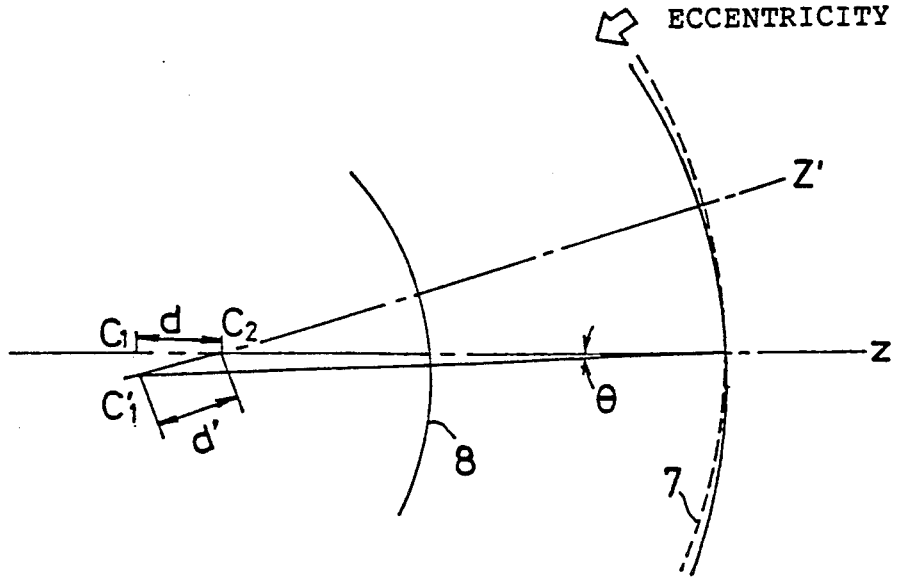
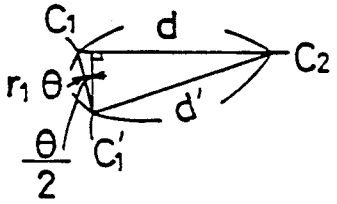
FIG. 6 (PRIOR ART)
FIG. 5 (PRIOR ART)
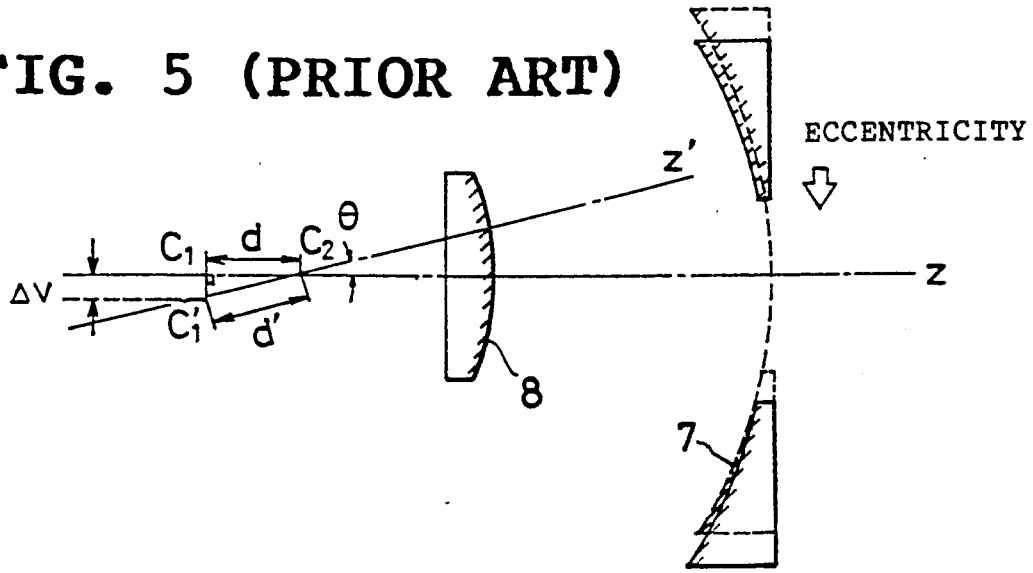

IMAGING TYPE X-RAY MICROSCOPE APPARATUS WITH SCHWARZSCHILD OPTICAL SYSTEM

BACKGROUND OF THE INVENTION

1. Field of the Invention

This invention relates to an X-ray microscope and particularly to an imaging X-ray microscope using a Schwarzschild optical system as its objective lens and utilizing the wavelength in the range of soft X-rays.

2. Description of the Related Art

Recently there has been a strong demand for observing an object image with high resolution using X-rays of a wavelength shorter than that of visible light, and X-ray microscopes have been developed in response to that demand.

Two types of X-ray microscopes are known: the scanning type and the imaging type. As shown in FIG. 1, a scanning X-ray microscope comprises an X-ray radiation source 1, a pin hole 2, an objective lens 3, a specimen 4 arranged movably in directions perpendicular to the optical axis of the objective lens 3, and an X-ray detector 5, all of which are arranged on the common optical axis. X-rays passing through the pin hole 2 are focused as a minute light spot on the specimen 4 by the objective lens 3, and the specimen 4 is moved in a plane perpendicular to the optical axis whereby a predetermined region of the specimen 4 is scanned to detect an image of the specimen having a certain size.

On the other hand, as shown in FIG. 2, an imaging X-ray microscope has a structure in which an X-ray radiation source 1, a condenser lens 6, a specimen 4, an objective lens 3, and an X-ray detector 5 are arranged coaxially. X-rays from the X-ray source 1 are focused on a region of a predetermined area on the specimen 4 by the condenser lens 6. The X-rays transmitted through or diffracted by the specimen 4 are focused on the detector 5 by the objective lens 3, and an image of the object having the predetermined size is formed.

As an optical system to be used as the objective lens of such an X-ray microscope, the Schwarzschild optical system is known. As shown in FIG. 3, this optical system comprises a concave mirror 7 having an opening in its center, and a convex mirror 8 which is arranged to oppose to the opening of the concave mirror 7. Light from the object point 0 is reflected successively by the concave mirror 7 and the convex mirror 8 to form an object image at the image point I.

When an imaging X-ray microscope is designed by using this Schwarzschild optical system as its objective lens, it is necessary to form an object image of a relatively large image height, thus the aberrations of the objective lens including offaxial aberration should be corrected well. Further, in order to obtain an image of sufficient brightness and high resolution, the numerical aperture on the object side of the objective lens must be large. Moreover, it is also necessary to prevent the deterioration of the imaging performance due to the error of assembly adjustment of the optical system.

There are two types of Schwarzschild optical systems: the concentric optical system in which the center of curvature $C_1$ of the concave mirror 7 is identical with that of curvature $C_2$ of the convex mirror 8, and the heterocentric optical system in which the center of curvature $C_1$ of the concave mirror 7 is not identical with that of curvature $C_2$ of the convex mirror 8. When viewed as the objective lens of an imaging X-ray microscope, these types have the following characteristics:

An example of the concentric Schwarzschild optical system is disclosed by P. Erdoes, Opt. Soc. America 49, 877(1959). In such an optical system, a strict degree of precision is required in its assembly adjustment and its error influences the imaging performance greatly. This will explained below.

FIGS. 4 and 5 are the diagrams for explaining the relationship between the concave mirror 7 and the convex mirror 8, and FIG. 6 is an enlarged view of the center of curvature in FIG. 4. In the figures, $C_1$ and $C_1'$ are the centers of curvature of the concave mirror 7, $C_2$ is the center of curvature of the convex mirror 8, d and d' are the distances between the centers of curvature of the concave mirror 7 and the convex mirror 8, and Z and Z' are the optical axes of the Schwarzschild optical system.

As shown in FIGS. 4 and 6, assume that the concave mirror 7 (having a radius of curvature $r_1$) becomes eccentric and its center of curvature shifts from $C_1$ to $C_1'$, that is, the concave mirror 7 rotates counterclockwise by an angle $\theta$ around the point of intersection of the optical axis Z and the concave mirror 7. Then the optical axis shifts from the straight line Z passing through $C_1$ and $C_2$ to the straight line Z' passing through $C_1'$ and $C_2$. The difference between the distance d from $C_1$ to $C_2$ and the distance d' from $C_1'$ to $C_2$ indicates the influence of eccentricity. Using the eccentric angle 0, d'-d is represented as follows:

$$\begin{aligned} d' - d &= [(r_1\cos(\theta/2))^2 + (d - r_1\sin(\theta/2))^2]^{\frac{1}{2}} - d \\ &= [d^2 - 2dr_1\sin(\theta/2) + r_1^2\theta^2]^{\frac{1}{2}} - d \\ &\simeq [d^2 - dr_1\theta^2 + r_1^2\theta^2]^{\frac{1}{2}} - d \\ &= r_1[[(d/r_1)^2 - (d/r_1)\theta^2 + \theta^2]^{\frac{1}{2}} - d/r_1] \\ &\simeq r_1[d/r_1 + (1/2)(r_1/d)\theta^2 - d/r_1] \\ &= (r_1\theta)^2/2d \end{aligned} \quad (1)$$

Further, as shown in FIG. 5, assume that the concave mirror 7 is displaced in a direction perpendicular to the optical axis Z and the center of curvature shifts from $C_1$ to $C_1'$. If the distance between $C_1$ and $C_1'$ is indicated by $\Delta v$, the difference between the distance d' from $C_1'$ to $C_1$ and the distance d from $C_1$ to $C_2$ is represented as follows:

$$\begin{aligned} d' - d &= d/\cos\theta - d \\ &= d/(1/\sqrt{1 + \tan^2\theta}) - d \\ &\simeq d/(1 - (1/2)(\Delta v/d)^2) - d \\ &= 2d^3/(2d^2 - (\Delta v)^2) - d \\ &\simeq (\Delta v)^2/2d \end{aligned} \quad (2)$$

As is apparent from equations (1) and (2), the influence of eccentricity is proportional to 1/d. Thus, a concentric Schwarzschild optical system in which d is zero or nearly equal to zero has the problem that the deterioration of performance due to the eccentric error is substantial. Therefore, the heterocentric optical system is advantageous in view of the eccentric error.

Hence the heterocentric optical system will be discussed below. As a measure of the deviation of the centers of curvature of the concave and convex mirrors of the Schwarzschild optical system, the heterocentric quantity DC defined by the following is introduced:

$DC$ = (distance between the centers of curvature of two

-continued reflecting mirrors)/(focal distance)

As examples of the heterocentric Schwarzschild optical system, I. Lovas, High Resolution Soft X-ray Optics, SPIE vol. 316(1981) discloses an optical system having DC $\simeq -0.022$ to $-0.071$ and the object-side numerical aperture NA $=0.2$, and SPIE vol. 563(1985) discloses an optical system having DC$\simeq -0.06$ and the object-side numerical aperture NA$=0.2$, 0.3 and 0.4.

However, the former optical system cannot provide sufficient image brightness since its numerical aperture is small. The latter optical system is difficult to use as the objective lens for the imaging X-ray microscope since offaxial aberration is large.

On the other hand, with respect to the aberration correction of the Schwarzschild optical system, Japanese Patent Publication No. 29-6775 is known. This discloses a method of determining the respective design parameters of the Schwarzschild optical system with the aberration correction considered, whether it is of the concentric or heterocentric type. The optical system analyzed there is designed for infinity, that is, the axial light beam exiting from the Schwarzschild optical system is parallel to the optical axis. As shown in FIG. 7, the state of correction of spherical aberration S and coma F is analyzed by representing the ratio $r_2/r_1$ (=a) of the radius of curvature $r_2$ of the convex mirror 8 to the radius of curvature $r_1$ of the concave mirror 7 along the horizontal axis and the ratio $d/r_2$ (=b) of the distance d between the centers of curvature of both mirrors to $r_2$ along the vertical axis. It is disclosed that if the optical system is designed in the range of the hatching in the figure, that is, $3 \leqq 1/a \leqq 14$, $-0.5 \leqq S \leqq 0.2$, $b \geqq 0$, then spherical aberration can be kept small. It is also disclosed that remaining aberration can be corrected well by coating the reflecting surfaces of the optical system designed as described above with a proper material to form aspherical surfaces.

However, if the Schwarzschild optical system is designed to satisfy the condition $b \geqq 0$ given there, the rays may be eclipsed at the edge of the convex mirror. Further, considering the simplicity of production of the reflecting mirror, it is not practical to make the mirror surface aspherical.

SUMMARY OF THE INVENTION

An object of the invention is to provide a Schwarzschild optical system as an objective lens of an imaging X-ray microscope, which is easy to produce and adjust, is bright and has excellent imaging performance.

An imaging X-ray microscope according to the present invention comprises an X-ray radiation source, a condenser lens for condensing X-rays radiated from the X-ray source on an object, an objective lens for forming an image of the object by the X-rays transmitted through or diffracted by the object, and an X-ray detector for receiving the image formed by the objective lens, the objective lens comprising a Schwarzschild optical system in which a concave mirror with an opening in the center thereof and a convex mirror are coaxially arranged in such a manner that the convex mirror opposes to the opening of the concave mirror, the object-side numerical aperture is at least 0.24, and the following condition is satisfied:

$$(N.A.-0.6)/12 \leqq (W_2-W_1)/f \leqq -0.005$$

where N.A. is the object-side numerical aperture of the Schwarzschild optical system, $W_1$ is the distance from the object to the center of curvature of the concave mirror, $W_2$ is the distance from the object to the center of curvature of the convex mirror, and f is the focal length of the Schwarzschild optical system.

Now, the present invention will be explained in detail.

FIG. 2 is a schematic view of an optical system of a microscope according to the present invention. Although this figure has been used hereinbefore to explain an imaging X-ray microscope in general, the general structure of an X-ray microscope according to the present invention is the same as that of a conventional one, thus FIG. 2 is also used as the view showing the constitution of the present invention. Since the elements in the figure have been described in connection with prior art, their description is not repeated here.

FIG. 3 is a detailed illustration of a part of an objective, that is, a Schwarzschild optical system of a microscope according to the present invention. Using the reference symbols in FIG. 3, the conditions to be satisfied by the Schwarzschild optical system according to the present invention are explained below.

First, the measure of evaluation of the imaging performance of the Schwarzschild optical system is explained.

In X-ray microscopes as well as in ordinary microscopes, the imaging performance is evaluated by the MTF (modulation transfer function) at the object point. In an X-ray microscope, a microchannel plate (hereinafter called "MCP") is used as a detector in an image plane. Since the pitch of pixels of the existing MCPs is about 10 μm, the resolution on the MCP side is about 20 μm. Therefore, when the magnification of the Schwarzschild optical system is represented by $\beta$, the resolution on the object side is 20 $\mu m/\beta$. Assuming that the number of pixels along one side of the MCP is about 1000, the height of image to be considered on the object side is $(10\ \mu m \times 500\sqrt{2})/\beta$.

The imaging performance necessary for an objective lens of an X-ray microscope is defined as such that the value of MTF at an axial point and a point at an image height of $(10\ \mu m \times 500\sqrt{2})/\beta$ is at least 30% for the spatial frequency $(20\ \mu m/\beta)^{-1}$ lines/mm estimated by the reciprocal of resolution. For example, if the magnification $\beta=100$, this standard means that the MTF at an axial point and an offaxial point at an image height of 70 μm is at least 30% for a spatial frequency of 5000 lines/mm. If the magnification varies, the standard spatial frequency and image height will naturally vary.

Next, since it is preferable that the brightness of the objective lens is one and a half times larger than that of N.A.$=0.2$, the following standard is set:

$$N.A. \geqq 0.24$$

Under the above evaluation standards, the heterocentric quantity DC has been made large to reduce the influence of the eccentric error, and study has been made to design an objective lens having a good imaging performance. As a result, it has been found that a Schwarzschild optical system ideal for the objective lens of an imaging X-ray microscope can be obtained if the relationship between the heterocentric quantity and the numerical aperture is defined to satisfy the following equation:

$$(N.A.-0.6)/12 \leqq (W_2-W_1)/f \leqq -0.005$$

If the heterocentric quantity becomes less than the lower limit of this equation, the MTF is 30% or less for the standard spatial frequency, so that no sufficient imaging performance cannot be obtained. On the other hand, if the heterocentric quantity becomes larger than the upper limit of this equation, then the influence of the eccentric error will be strong, the performance of the objective lens becomes unstable and the production is difficult.

BRIEF DESCRIPTION OF THE DRAWINGS

FIGS. 4 to 6 are diagrams showing the eccentricity of the concave and convex mirrors constituting the Schwarzschild optical system;

DESCRIPTION OF THE PREFERRED EMBODIMENTS

Figure 1:
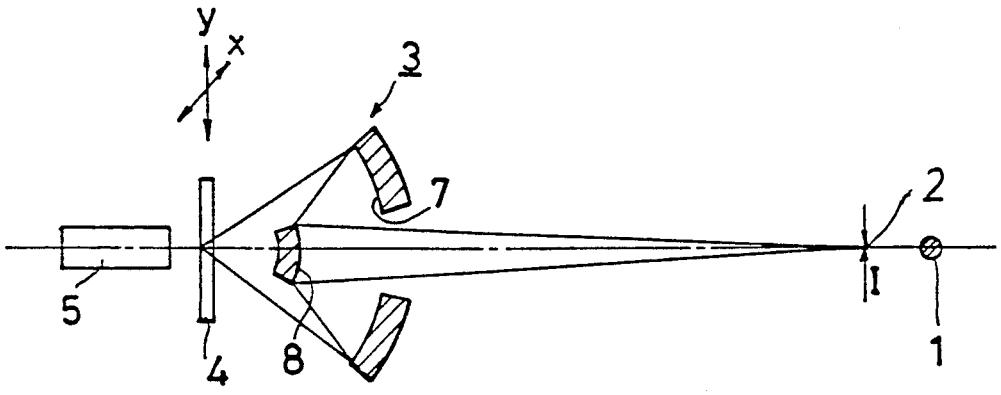
FIG. 1 (PRIOR ART)
FIG. 1 is a schematic view of a scanning X-ray microscope.
Figure 2:
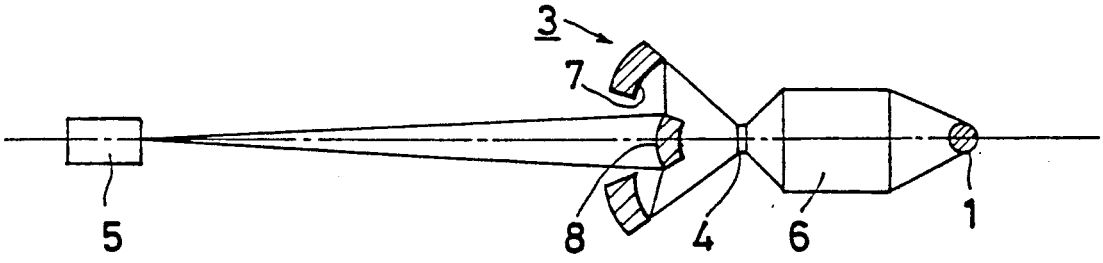
FIG. 2 (PRIOR ART)
FIG. 2 is a schematic view of an imaging X-ray microscope.
Figure 3:
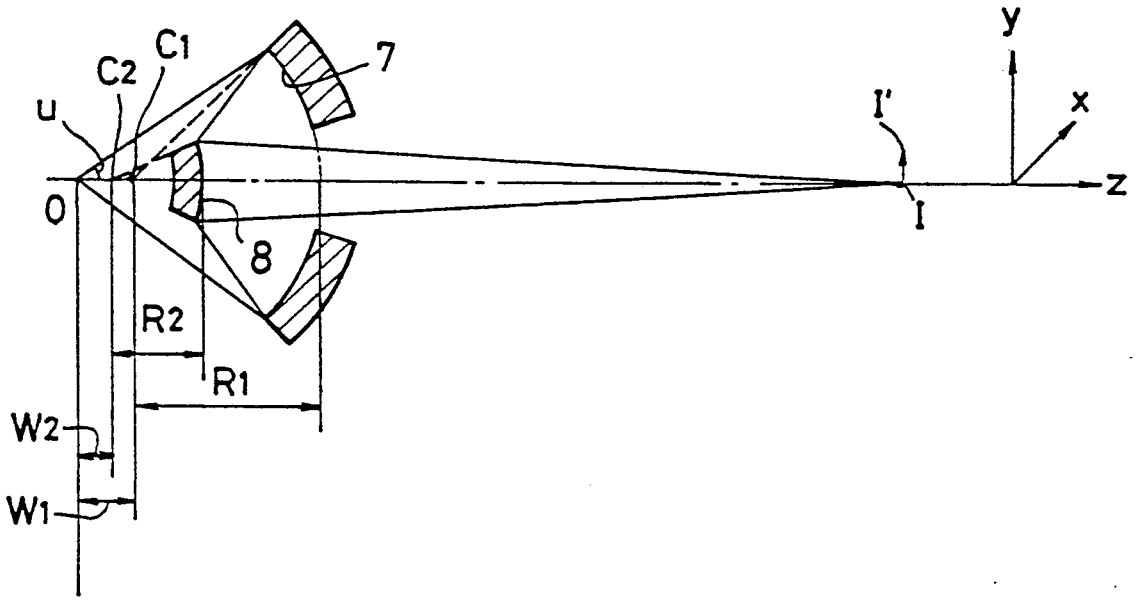
FIG. 3 is a sectional view of a Schwarzschild optical system.
Figure 7:
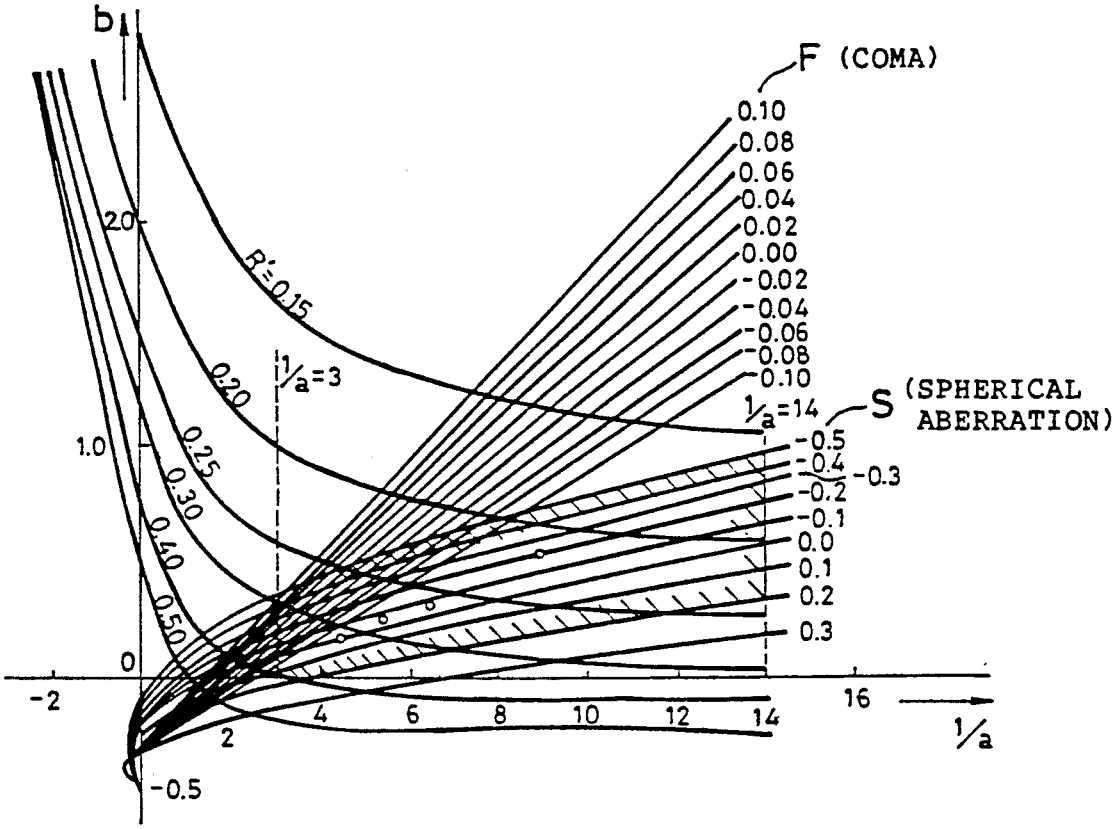
FIG. 7 (PRIOR ART)
FIG. 7 is a graph showing the conditions for aberration correction of the Schwarzschild optical system.

Preferred embodiments of the present invention are described below. FIG. 3 shows a heterocentric Schwarzschild optical system suitable for the objective of an imaging X-ray microscope. Each embodiment is shown by listing the parameters of FIG. 3, that is, the values of R1, R2, W1, and W2, and the focal length and heterocentric quantity of the Schwarzschild optical system.

EMBODIMENT 1

Magnification 100×, NA=0.25, DC=−0.01

The dimensions of this embodiment in terms of the parameters shown in FIG. 3 are as follows:

| | | |
|---|---|---|
| R1 | 30.228 | |
| R2 | 11.973 | |
| W1 | 9.739 | |
| W2 | 9.639 | |
| T | 1000.0 | |
| f | 9.804 | |
| DC | −0.01 | (unit: mm) |

where $DC=(W_2-W_1)/f$.

Figure 8:
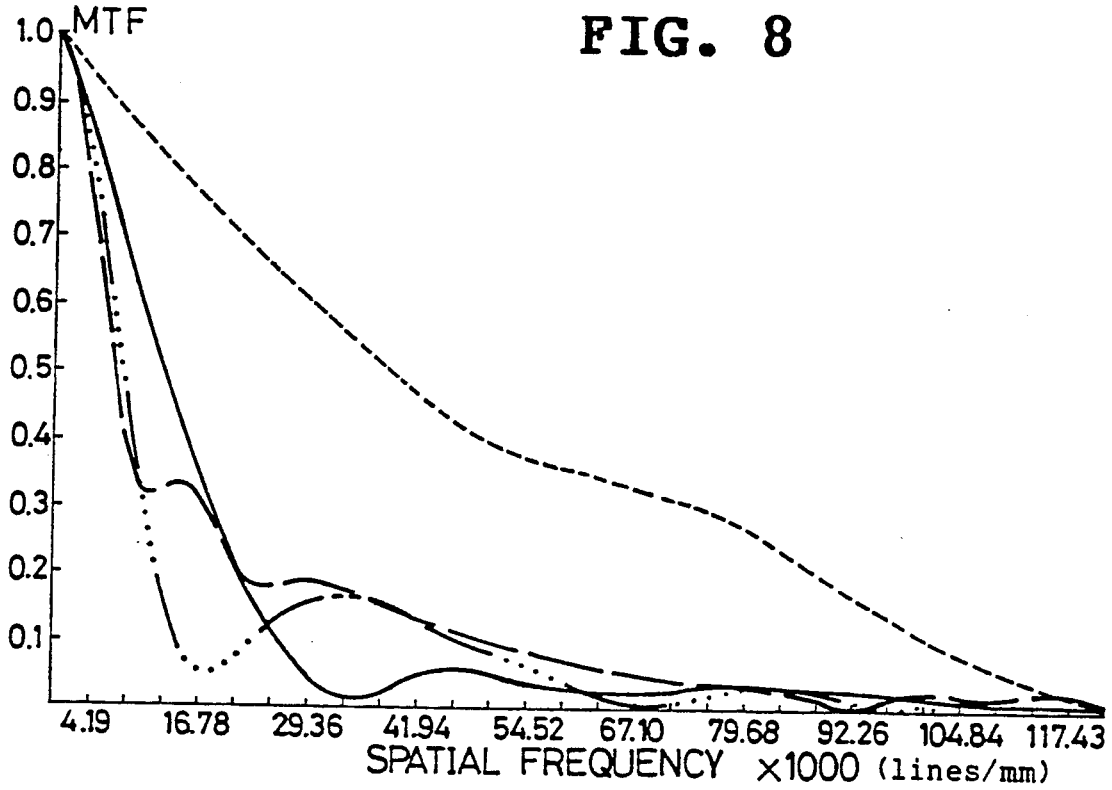
FIGS. 8 to 18 are graphs showing the MTF curves of first to eleventh embodiments of the present invention.

FIG. 8 shows the spatial frequency response of the optical system of this embodiment with MTF and spatial frequency represented on the vertical and horizontal axes, respectively. The broken line represents the MTF at the null-aberration diffraction limit and the solid line indicates the actual MTF on the optical axis (point I). The dash line and the dash-six-dot line represent the MTF off the optical axis (point I') in the tangential and sagital directions, respectively. It can be seen that the MTF contrast of a spatial frequency of 5000 lines/mm is 30% or more on and off the axis and it is a good optical system satisfying the standards.

The wavelength used is 3.98 nm.

In this embodiment, the deterioration of MTF is due to the geometric-optical aberration and the result is substantially the same with other wavelengths.

The specifications of embodiments 2 to 11 are presented below and the respective MTFs are shown in FIGS. 9 to 18.

EMBODIMENT 2

Magnification 100×, NA=0.24, DC=−0.0275

| | | |
|---|---|---|
| R1 | 26.497 | |
| R2 | 11.501 | |
| W1 | 9.446 | |
| W2 | 9.176 | |
| T | 1000.0 | |
| f | 9.808 | |
| DC | −0.0275 | (unit: mm) |

Figure 9:
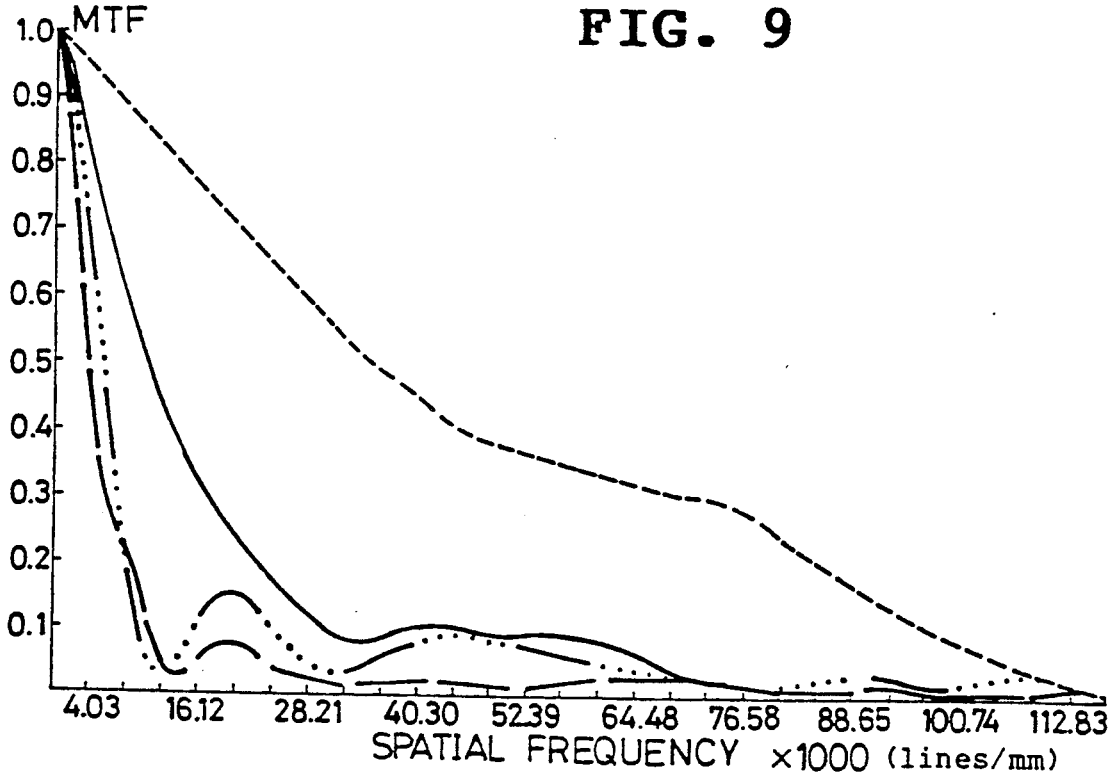

FIG. 9 shows that the MTF contrast of a spatial frequency of 5000 lines/mm is about 30% on and off the axis and it is an optical system which is near the limit of satisfying the standards.

EMBODIMENT 3

Magnification 100×, NA=0.24, DC=−0.0005

| | | |
|---|---|---|
| R1 | 31.311 | |
| R2 | 12.096 | |
| W1 | 9.821 | |
| W2 | 9.771 | |
| T | 1000.0 | |
| f | 9.804 | |
| DC | −0.0005 | (unit: mm) |

Figure 10:
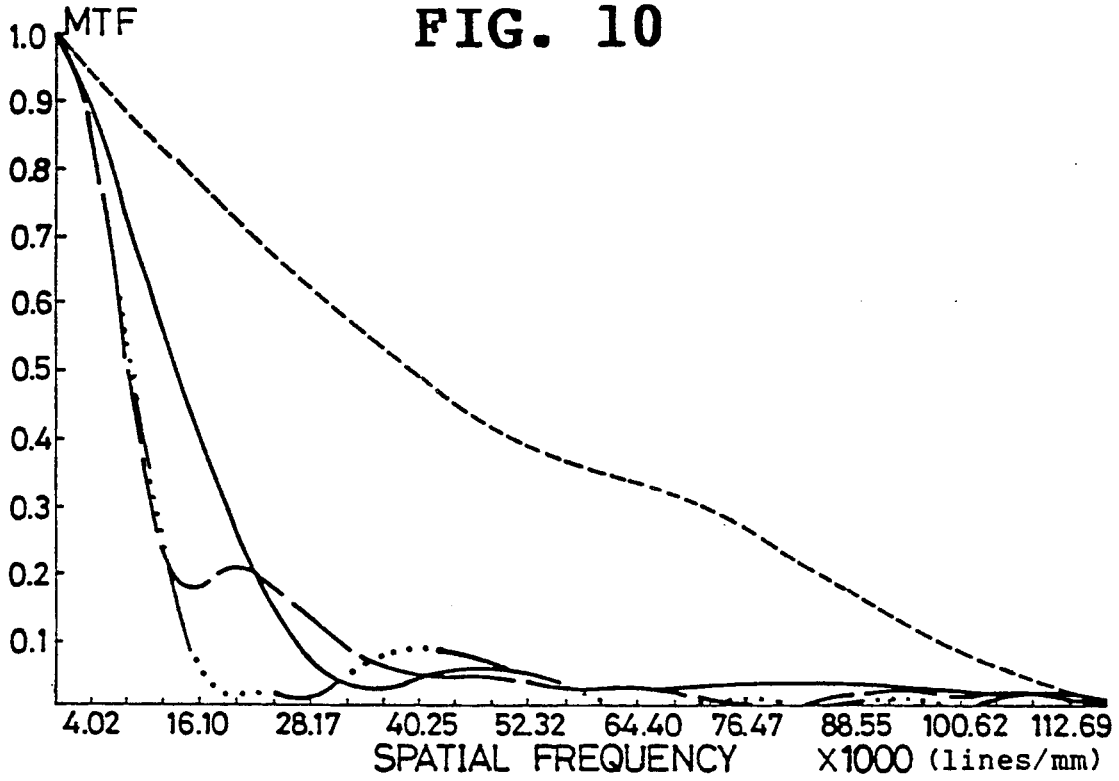

FIG. 10 shows that the MTF contrast of a spatial frequency of 5000 lines/mm is about 30% on and off the axis and it satisfies the standards.

EMBODIMENT 4

Magnification 100×, NA=0.30, DC=−0.022

| | | |
|---|---|---|
| R1 | 27.460 | |
| R2 | 11.625 | |
| W1 | 9.534 | |
| W2 | 9.314 | |
| T | 1000.0 | |
| f | 9.807 | |
| DC | −0.022 | (unit: mm) |

Figure 11:
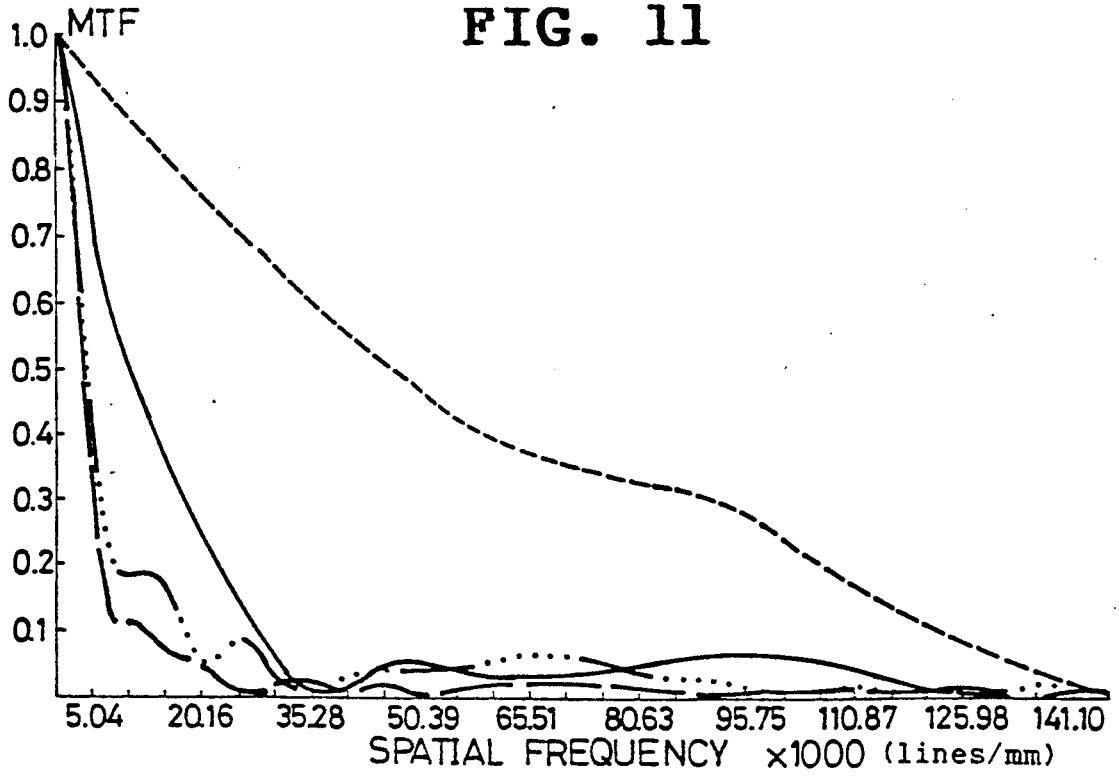

FIG. 11 shows that the MTF contrast of a spatial frequency of 5000 lines/mm is about 30% on and off the axis and it is an optical system which is near the limit of satisfying the standards.

EMBODIMENT 5

Magnification 100×, NA=0.32, DC=−0.02

| | | |
|---|---|---|
| R1 | 27.842 | |
| R2 | 11.673 | |
| W1 | 9.568 | |
| W2 | 9.368 | |
| T | 1000.0 | |
| f | 9.807 | |
| DC | −0.02 | (unit: mm) |

Figure 12:
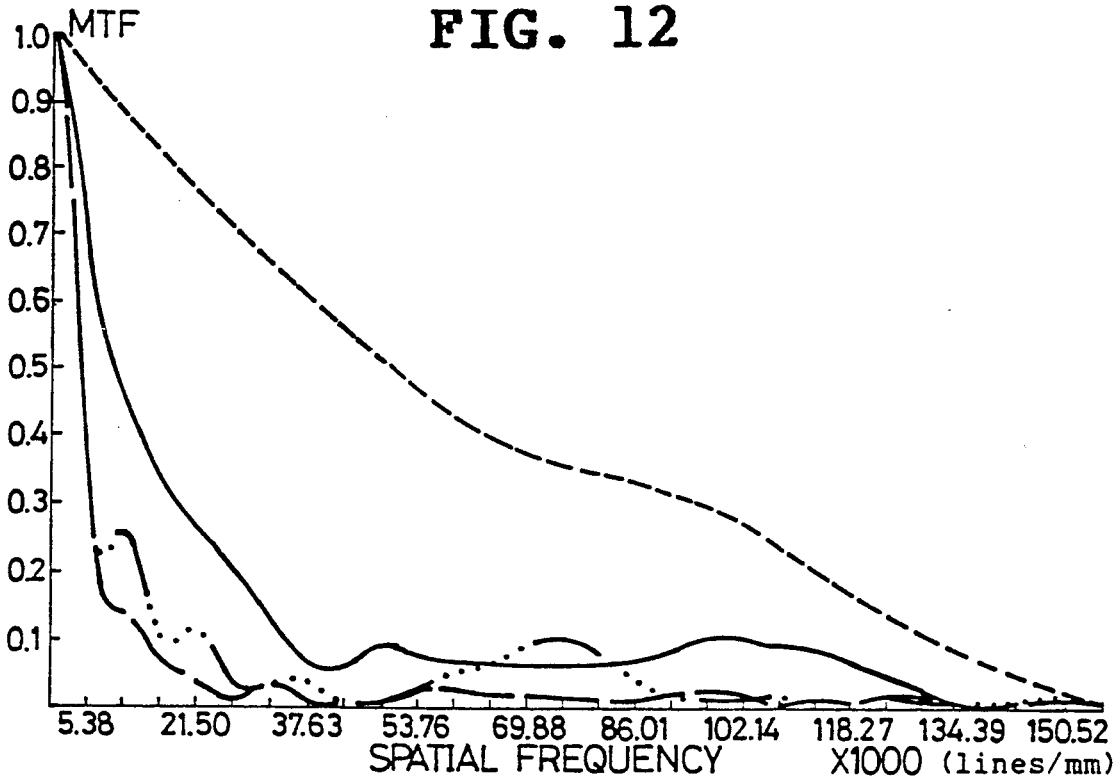

FIG. 12 shows that the MTF contrast of a spatial frequency of 5000 lines/mm is about 30% on and off the axis and it is an optical system which is near the limit of satisfying the standards.

EMBODIMENT 6

Magnification 200×, NA=0.25, DC=−0.01

| | | |
|---|---|---|
| R1 | 15.040 | |
| R2 | 6.010 | |
| W1 | 4.893 | |
| W2 | 4.843 | |
| T | 1000.0 | |
| f | 4.951 | |
| DC | −0.01 | (unit: mm) |

Figure 13:
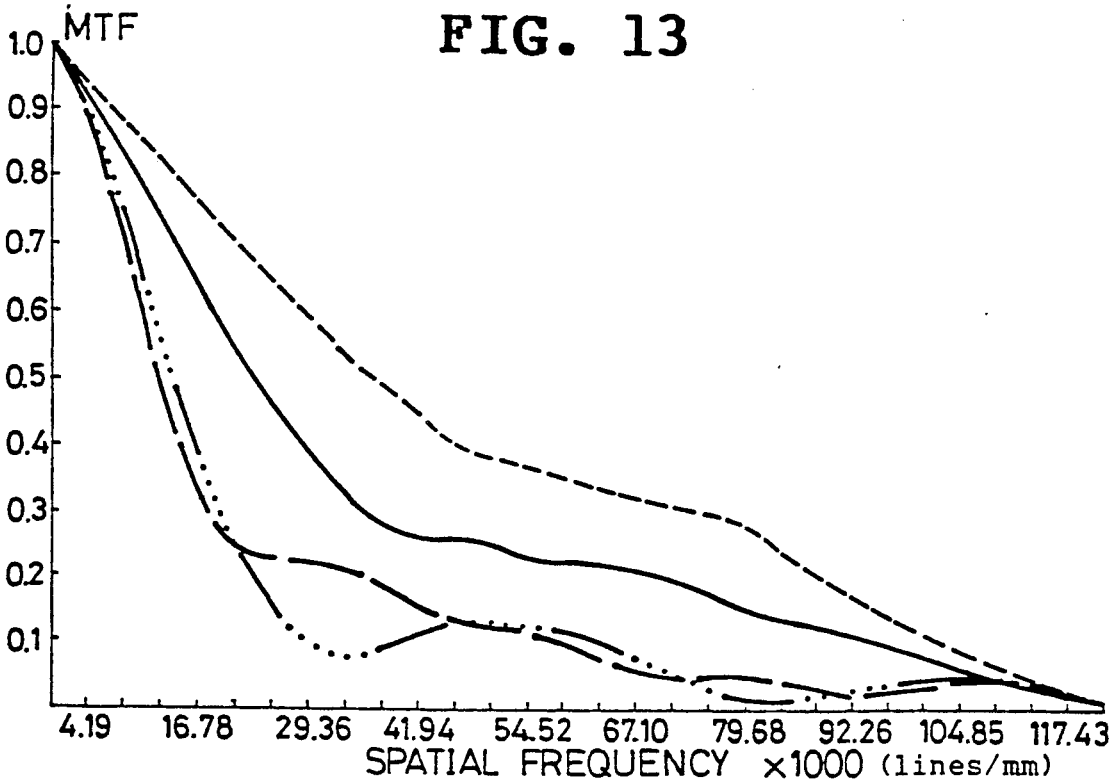

FIG. 13 shows that the MTF contrast of a spatial frequency of 10000 lines/mm is 30% or more on and off the axis and it is a good optical system satisfying the standards.

EMBODIMENT 7

Magnification 200×, NA=0.30, DC=−0.01

| | | |
|---|---|---|
| R1 | 14.965 | |
| R2 | 5.999 | |
| W1 | 4.893 | |
| W2 | 4.843 | |
| T | 1000.0 | |
| f | 4.951 | |
| DC | −0.01 | (unit: mm) |

Figure 14:
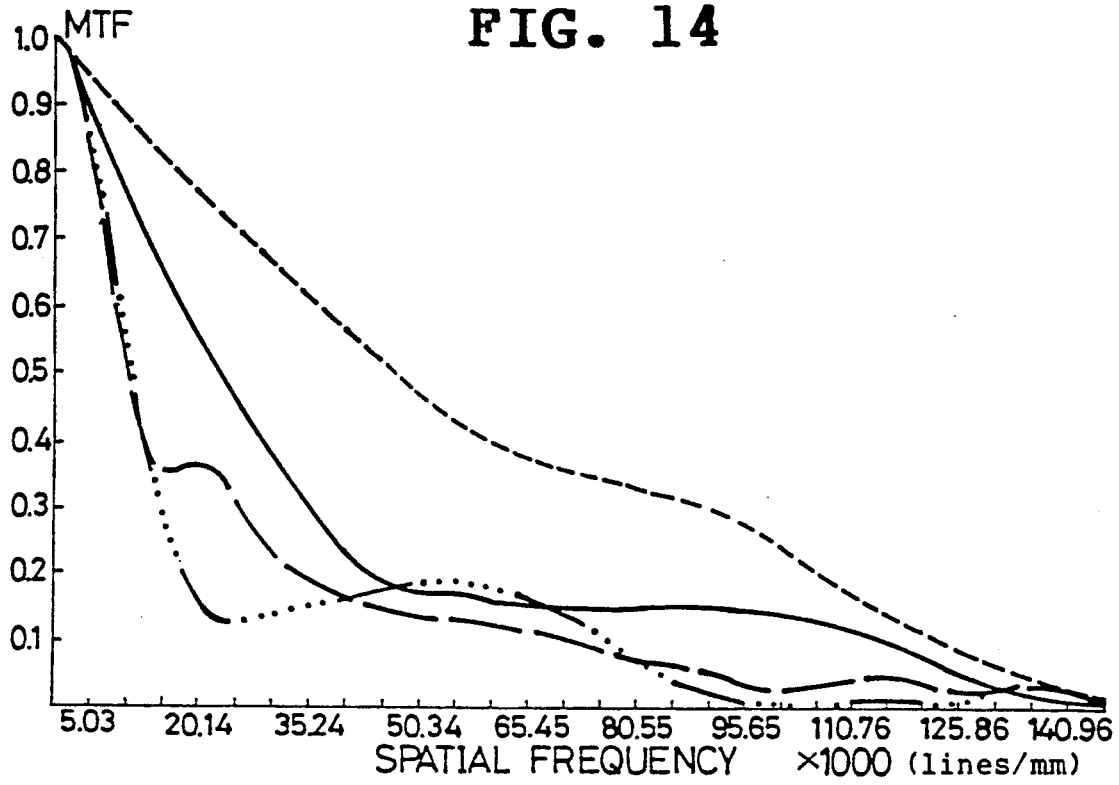

FIG. 14 shows that the MTF contrast of a spatial frequency of 10000 lines/mm is 30% or more on and off the axis and it is a good optical system satisfying the standards.

EMBODIMENT 8

Magnification 400×, NA=0.25, DC=−0.01

| | | |
|---|---|---|
| R1 | 7.502 | |
| R2 | 3.011 | |
| W1 | 2.453 | |
| W2 | 2.428 | |
| T | 1000.0 | |
| f | 2.488 | |
| DC | −0.01 | (unit: mm) |

Figure 15:
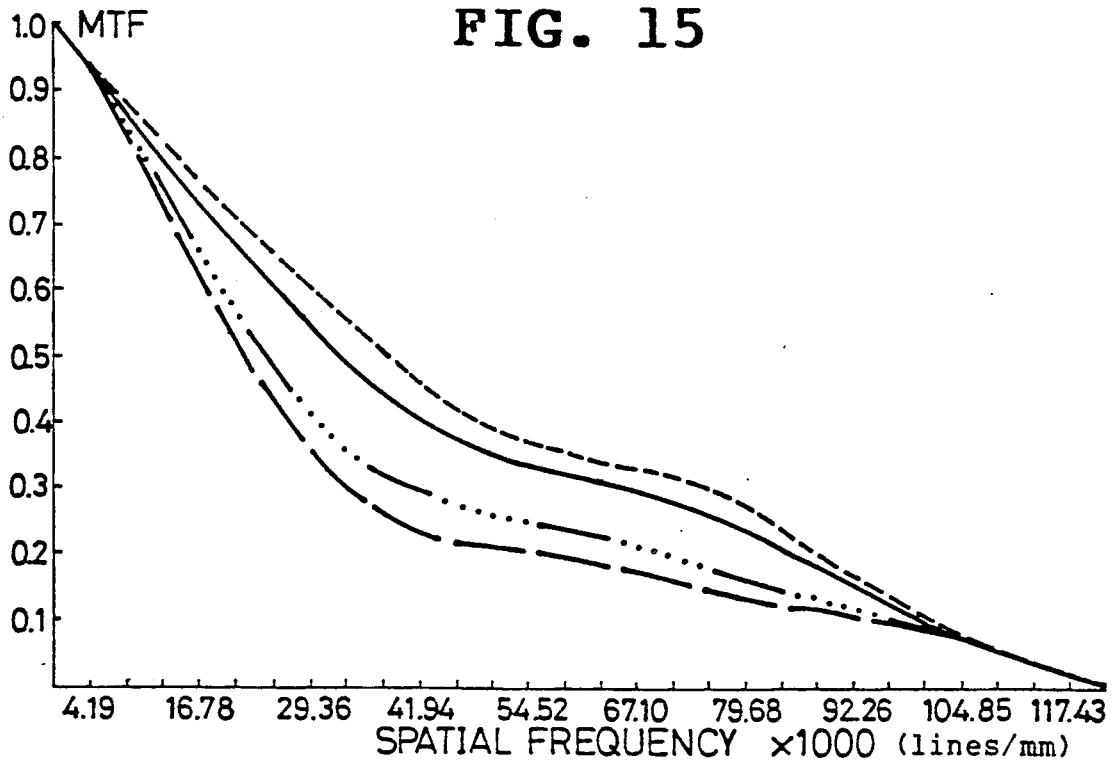

FIG. 15 shows that the MTF contrast of a spatial frequency of 20000 lines/mm is 30% or more on and off the axis and it is a good optical system satisfying the standards.

EMBODIMENT 9

Magnification 200×, NA=0.25, DC=−0.02

| | | |
|---|---|---|
| R1 | 13.951 | |
| R2 | 5.875 | |
| W1 | 4.807 | |
| W2 | 4.707 | |
| T | 1000.0 | |
| f | 4.951 | |
| DC | −0.02 | (unit: mm) |

Figure 16:
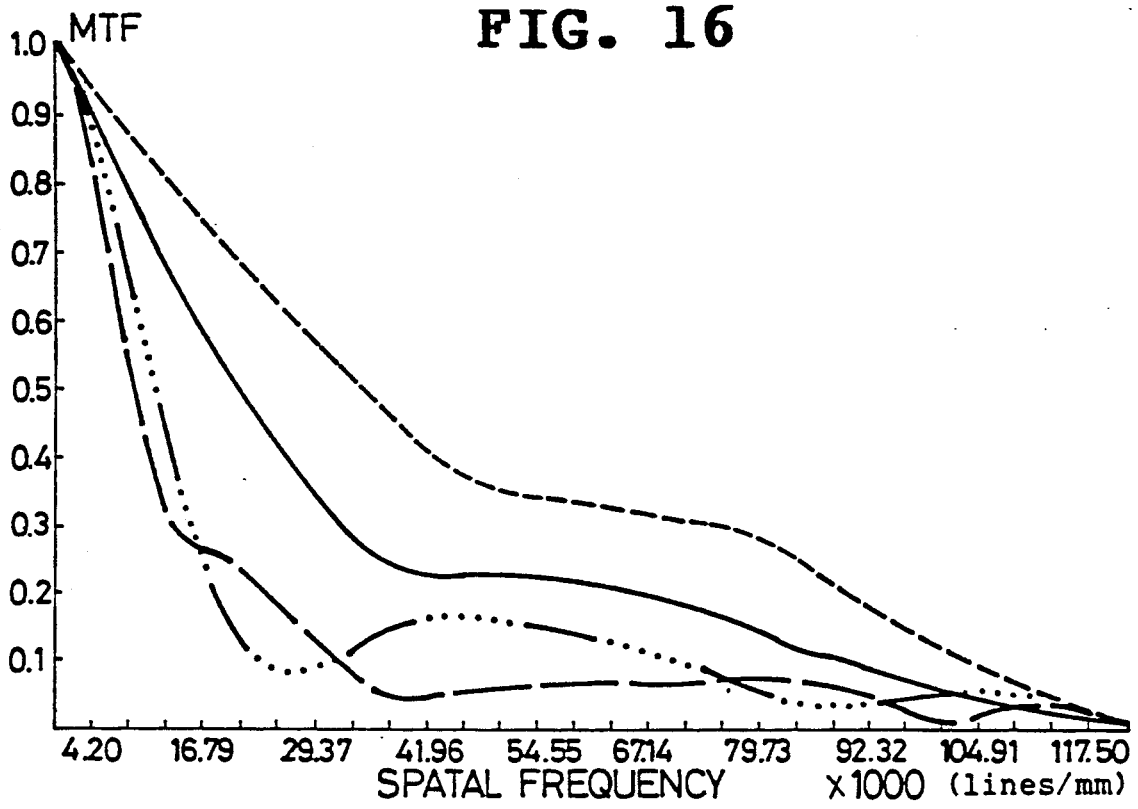

FIG. 16 shows that the MTF contrast of a spatial frequency of 10000 lines/mm is 30% or more on and off the axis and it is a good optical system satisfying the standards.

EMBODIMENT 10

Magnification 200×, NA=0.3, DC=−0.015

| | | |
|---|---|---|
| R1 | 14.428 | |
| R2 | 5.933 | |
| W1 | 4.850 | |
| W2 | 4.775 | |
| T | 1000.0 | |
| f | 4.951 | |
| DC | −0.015 | (unit: mm) |

Figure 17:
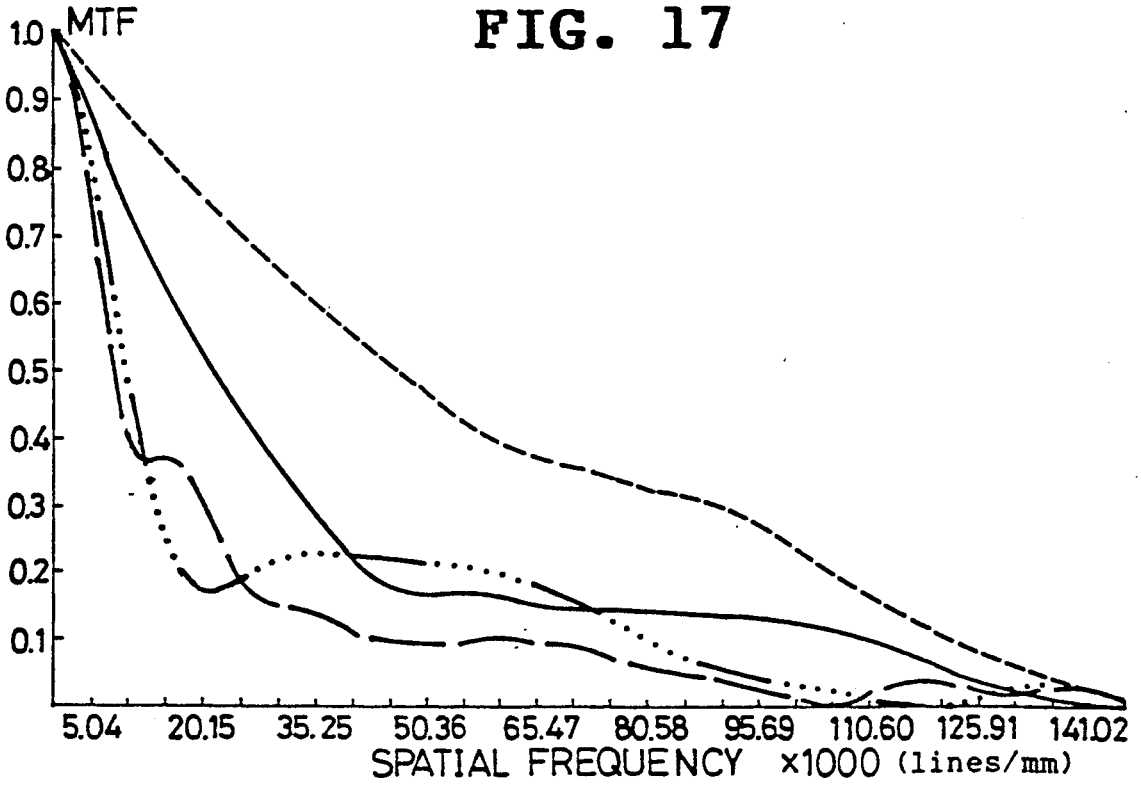

FIG. 17 shows that the MTF contrast of a spatial frequency of 10000 lines/mm is 30% or more on and off the axis and it is a good optical system satisfying the standards.

EMBODIMENT 11

Magnification 200×, NA=0.32, DC=−0.01

| | | |
|---|---|---|
| R1 | 14.932 | |
| R2 | 5.994 | |
| W1 | 4.893 | |
| W2 | 4.843 | |
| T | 1000.0 | |
| f | 4.951 | |
| DC | −0.01 | (unit: mm) |

Figure 18:
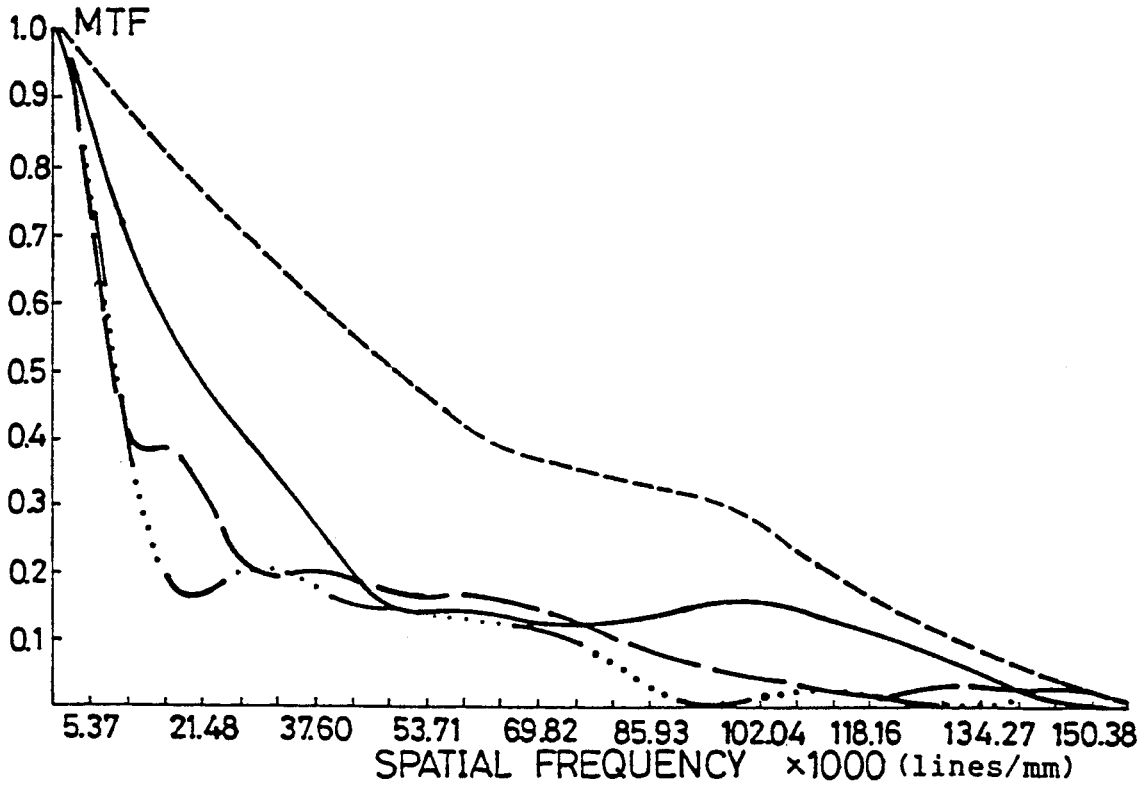

FIG. 18 shows that the MTF contrast of a spatial frequency of 10000 lines/mm is 30% or more on and off the axis and it is a good optical system satisfying the standards.

Also in embodiments 2 to 11, a wavelength of 3.98 nm is used.

In the above embodiments as well as in embodiment 1, the deterioration of MTF is due to the geometric-optical aberration and the results are the same with other wavelengths.

Figure 19:
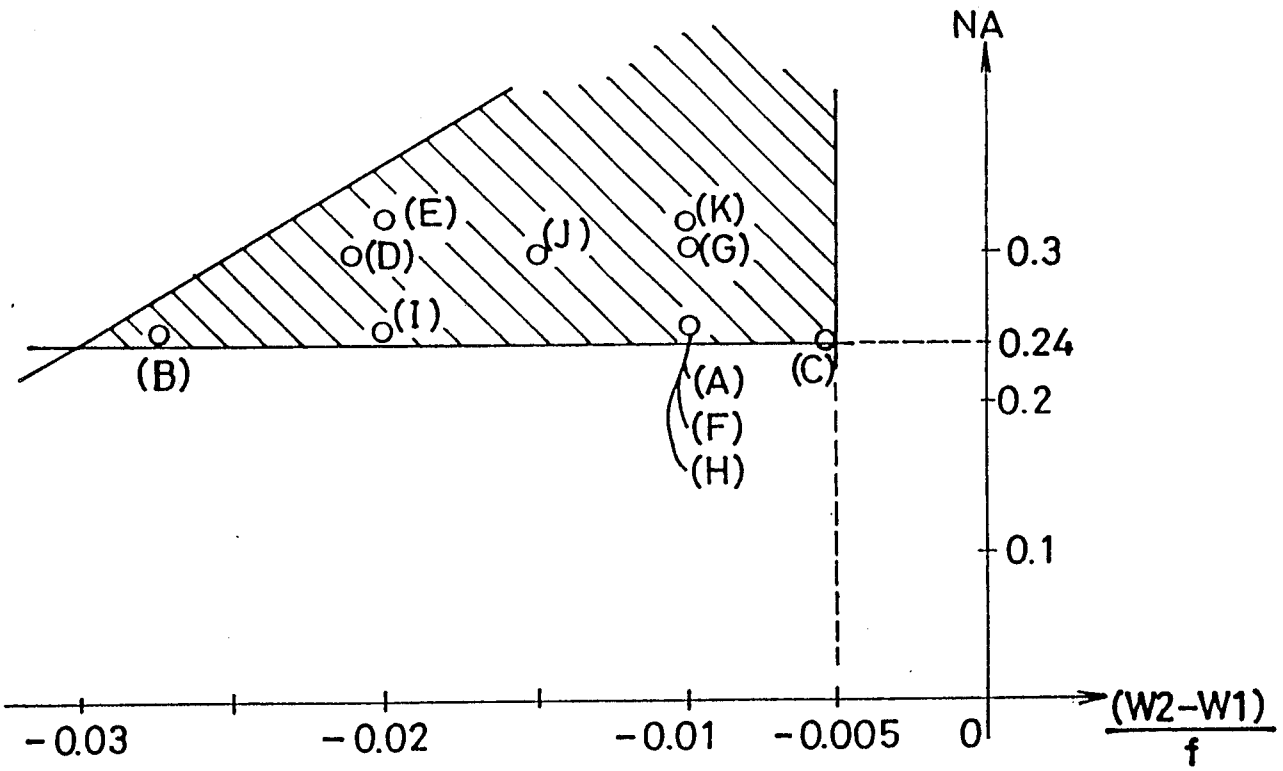
FIG. 19 is a graph showing the relationship between the numerical aperture and the heterocentric quantity of the respective embodiments of the present invention.

In FIG. 19, embodiments 1 to 11 are plotted with the object-side numerical aperture and the heterocentric quantity represented on the vertical and horizontal axes, respectively. The points (A) to (K) correspond to embodiments 1 to 11, respectively. As is apparent from this figure, the embodiments exist in the hatching area, that is, the area satisfying the conditions of the present invention and good objective lenses can be realized in this area.

What is claimed is:

1. An imaging X-ray microscope comprising:

an X-ray radiation source;

a condenser for condensing X-rays radiated from the X-ray source on an object;

an objective for forming an image of the object by the X-rays transmitted through or diffracted by the object; and an X-ray detector for receiving the image formed by the objective;

the objective comprising a Schwarzschild optical system in which a concave mirror with an opening in the center thereof and a convex mirror are coaxially and heterocentrically arranged in such a manner that the convex mirror opposes to the opening of the concave mirror, the object-side numerical aperture is at least 0.24, and the following condition is satisfied:

$$(N.A.-0.6)/12 \leqq (W_2-W_1)/f \leqq -0.005$$

where N.A. is the object-side numerical aperture of the Schwarzschild optical system, $W_1$ is the distance from the object to the center of curvature of the concave mirror, $W_2$ is the distance from the object to the center of curvature of the convex mirror, and f is the focal length of the Schwarzschild optical system.

2. A Schwarzschild optical system comprising a concave mirror with an opening in the center thereof and a convex mirror arranged opposite to the opening of the concave mirror, wherein the concave mirror and the convex mirror are coaxially and heterocentrically arranged, the object-side numerical aperture is at least 0.24, and the following condition is satisfied:

$$(N.A.-0.6)/12 \leqq (W_2-W_1)/f \leqq -0.005$$

where N.A. is the object-side numerical aperture of the Schwarzschild optical system, $W_1$ is the distance from the object to the center of curvature of the concave mirror, $W_2$ is the distance from the object to the center of curvature of the convex mirror, and f is the focal length of the Schwarzschild optical system.

* * * * *